US006182346B1

(12) United States Patent
Flathau et al.

(10) Patent No.: US 6,182,346 B1
(45) Date of Patent: Feb. 6, 2001

(54) METHOD OF RETROFITTING A CONCRETE FORM

(75) Inventors: Robert J. Flathau, Cary; Alan E. Soltysik, Des Plaines; Robert A. Spindler, Carol Stream, all of IL (US)

(73) Assignee: Symons Corporation, Des Plaines, IL (US)

( * ) Notice: Under 35 U.S.C. 154(b), the term of this patent shall be extended for 433 days.

(21) Appl. No.: 08/935,609

(22) Filed: Sep. 23, 1997

Related U.S. Application Data

(62) Division of application No. 08/524,652, filed on Sep. 8, 1995, now Pat. No. 5,707,539.

(51) Int. Cl.[7] ..... B23P 17/04
(52) U.S. Cl. ..... 29/401.1
(58) Field of Search ..... 249/189, 210, 249/219.1, 219.2, 33; 29/401.1, 897, 897.1, 897.31, 897.312

(56) References Cited

U.S. PATENT DOCUMENTS 2,574,274 11/1951 McMullan ..... 25/131

OTHER PUBLICATIONS

Economy Forms Corporation, "EFCO Plate Girder Building Forms" Engineering Data, 1 page—prior art.
Symons Corporation, Max–A–Form, p. B–1, 1 page—prior art.
Slaughter Industries, Inc. Mini–Max Panel System drawing, Panel–Tie Details, 1 sheet—prior art.
Symons Corporation, 24" Steel–Ply Panel, Drawing No. SA–50 (1981).
Symons Corporation, Max–A–Form Concrete Forming System, 8 pages (1993).
Symons Corporation, "Versiform Concrete Forming System", 24 pages (1986).
Economy Forms Corporation, "Super Stud System", 28 pages (Mar. 1991).
RMD Companies, RMD Construction Equipment, 44 pages (Jul. 1982).

*Primary Examiner*—Michael Safavi
(74) *Attorney, Agent, or Firm*—Marshall, O'Toole, Gerstein, Murray & Borun

(57) ABSTRACT

A concrete form having a frame with a first pair of outer frame members and a second pair of outer frame members. The first pair of outer frame members are disposed perpendicular to the second pair of outer frame members so that the first and second pairs of outer frame members define a substantially rectangular shape. The concrete form has two inner frame members connected between two of the outer frame members, the inner frame members being spaced to define a rectangular bay area therebetween. The concrete form has a flat concrete-forming member fixed to the outer frame, and a support member with a pair of end portions and a middle portion disposed between the end portions. The support member is connected to the first and second inner frame members so that the middle portion of the support member is spaced from the concrete-forming member by a first distance and so that the end portions of the support member are spaced from the concrete-forming member by a second distance smaller than the first distance.

4 Claims, 2 Drawing Sheets

METHOD OF RETROFITTING A CONCRETE FORM

This is a Divisional of U.S. application Ser. No. 08/542,652, filed Sep. 8, 1995 now U.S. Pat. No. 5,707,539.

BACKGROUND OF THE INVENTION

The present invention relates to modular concrete forms of the type used to form cavities into which concrete may be poured.

A conventional concrete form is composed of a frame having two pairs of parallel outer steel rails, one pair of rails being perpendicular to the other pair of rails so as to form a rectangular frame. The frame may have a number of parallel inner rails which are connected to the outer-rails to form a number of rectangular bays within the frame. A concrete-forming plate, which may be plywood for example, is secured to the frame.

A number of such conventional concrete forms are typically positioned adjacent each other, and sometimes on top of each other, to form cavities of various shapes and sizes into which wet concrete may be poured. When so positioned, the concrete forms are securely fastened together, such as by bolts or wedges which pass through holes or slots formed in the outer rails of adjacent concrete forms, so that the pressure of the wet concrete does not alter the position of the concrete forms. When the concrete dries, the concrete forms are removed and may be reused.

SUMMARY OF THE INVENTION

The present invention is directed to a concrete form with one or more internal support members connected between adjacent inner rails and to a method of retrofitting a preexisting concrete form with one or more of such support members.

A concrete form in accordance with the invention may have an outer frame with a first pair of outer frame members and a second pair of outer frame members, the first pair of outer frame members being disposed perpendicular to the second pair of outer frame members so that the first and second pairs of outer frame members define a rectangular shape. The concrete form has at least two inner frame members connected between two of the outer frame members to define a rectangular bay area, and a flat concrete-forming member is fixed to the outer frame. The concrete form may have a support member with a pair of end portions and a middle portion disposed between the end portions, and the support member may be nonlinear and connected to the inner frame members so that one of the end portions is spaced from the concrete-forming member by a first distance and so that the middle portion of the nonlinear support member is spaced from the concrete-forming member by a second distance greater than the first distance.

The nonlinear support member may be provided in the form of a rod having two semi-circular ends. The semi-circular ends may each define a plane substantially parallel to the plane defined by the concrete-forming member, and they may also each pass through one of the inner frame members twice. Alternatively, the nonlinear support member could have one or more linear threaded ends instead of curved ends.

A concrete form in accordance with the invention may have a frame formed of outer and inner frame members which form a number of rectangular bays within the frame, including a pair of outer bays which have three sides defined by the outer frame members and a fourth side defined by one of the inner frame members and a plurality of inner bays which have two sides defined by the outer frame members and two sides defined by a pair of the inner frame members. The concrete form has a plurality of support members connected to the inner frame members such that the bays include a plurality of bays which are unobstructed by the support members and a plurality of safety bays across which one of the support members is disposed. The unobstructed and safety bays are positioned so that each of the safety bays is separated from another of the safety bays by at least one of the unobstructed bays.

The invention is also directed to a method of retrofitting a support member to a preexisting concrete form, which includes the steps of forming a hole in a first inner frame member of the preexisting concrete form, forming a hole in a second inner frame member of the preexisting concrete form, placing a support member so that the first end of the support member passes through the hole in the first inner frame member and so that the second end of the support member passes through the hole in the second inner frame member, and securing the support member to the first and second inner frame members to maintain the position of the support member.

These and other features and advantages of the present invention will be apparent to those of ordinary skill in the art in view of the detailed description of the preferred embodiment, which is made with reference to the drawings, a brief description of which is provided below.

DETAILED DESCRIPTION OF A PREFERRED EMBODIMENT

Figure 1:
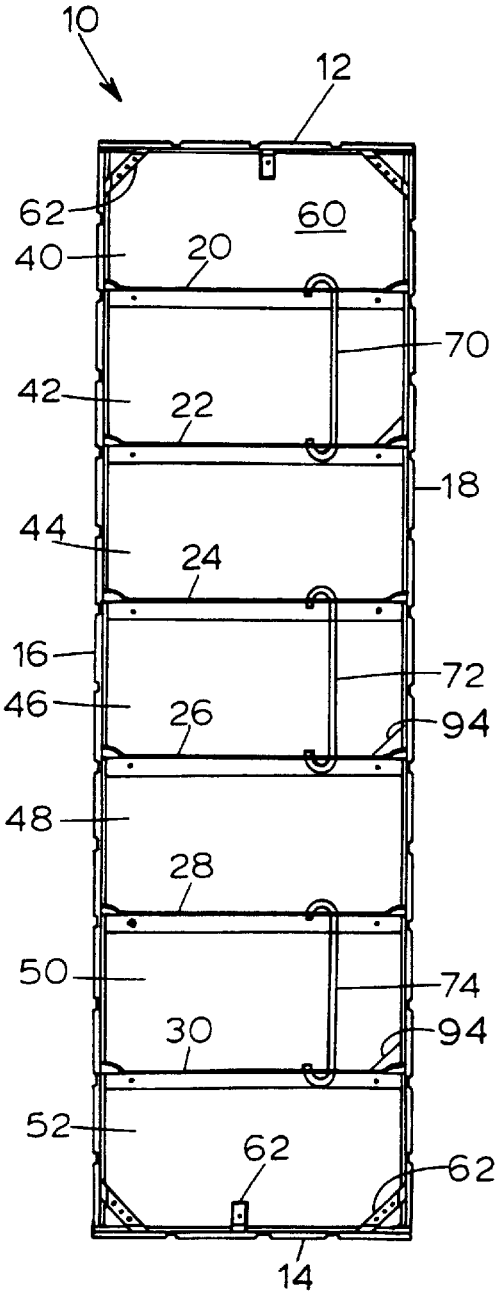
FIG. 1 illustrates a first embodiment of a concrete form in accordance with the invention.
Figure 2:
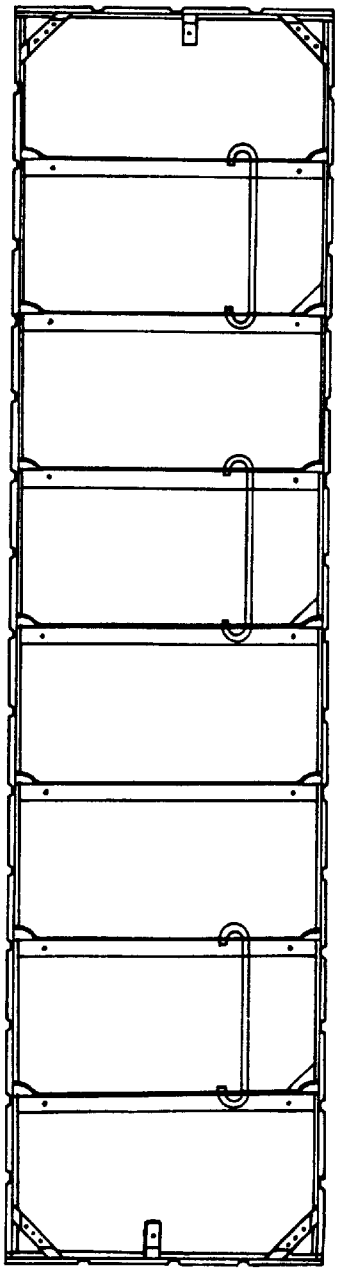
FIG. 2 illustrates a second embodiment of a concrete form in accordance with the invention.

A front view of a preferred embodiment of a concrete form 10 in accordance with the invention has been illustrated in FIGS. 1 and 2. The concrete form 10 is a modular unit which may be positioned adjacent other concrete forms to form a concrete-forming wall or enclosure. A number of forms 10 are typically placed side-by-side, and may also be placed on top of each other. By way of example, a typical concrete form may have a width of approximately two feet and a height of approximately eight feet (see FIG. 2).

Referring to FIG. 1, the concrete form 10 has a frame composed of a first pair of outer frame members in the form of rails 12, 14 shown horizontally in FIG. 1 and a second pair of outer frame members in the form of rails 16, 18 shown vertically in FIG. 1. The outer frame members 12–18 may be in the form of relatively thin steel rails having a width of two or three inches. Each of the outer rails 16, 18 may be composed of a single rail or a number of rails longitudinally joined together. The outer rails 12–18 may have holes or slots formed therein to accommodate bolts or wedges to securely fasten a number of concrete forms 10 together. The particular design of the rails 12–18 is not considered important to the invention.

Figure 6:
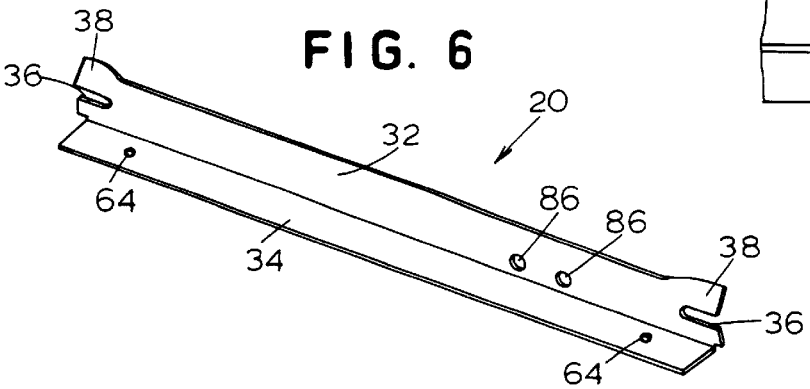
FIG. 6 is a perspective view of an inner rail of the concrete forms of FIGS. 1 and 2.

The frame of the concrete form 10 illustrated in FIG. 1 has six inner frame members in the form of steel rails 20–30, each of which has a first end connected to the outer rail 16 and a second end connected to the outer rail 18. The inner rails 20–30 may be connected to the outer rails 16, 18 by any suitable means, such as welding. As shown in FIG. 6, each of the inner rails 20–30 is L-shaped, being composed of a pair of sides 32, 34 disposed perpendicular to each other. Each end of the side 32 has a horizontal slot 36 formed therein and an upper end portion 38 that is angled slightly outwardly.

In the embodiment illustrated in FIG. 1, the inner rails 20–30 are aligned parallel to each other and perpendicular to the outer rails 16, 18 so as to define a number of rectangular bays 40–52. The bays 40–52 include two outer bays 40, 52 and five inner bays 42–50. The outer bay 40 has three sides which are defined by the outer rails 12, 16, 18 and one side which is defined by the inner rail 20. The outer bay 52 has three sides which are defined by the outer rails 14, 16, 18 and one side which is defined by the inner rail 30. Each of the inner bays 42–50 has two sides defined by the outer rails 16, 18 and two sides defined by a respective pair of the inner rails 20–30.

The frame of the concrete form 10 is attached to a flat concrete-forming member in the form of a plate 60, such as plywood or a relatively thin steel sheet, having a rectangular shape that corresponds to the rectangular shape defined by the outer rails 12–18. If composed of plywood, the concrete-forming plate 60 may be attached to the frame by screws threaded into a number of brackets 62 welded or otherwise attached to the frame. The screws may also be threaded into the plate 60 via a number of holes 64 in the inner rails (see FIG. 6). If composed of steel, the concrete-forming plate 60 may be welded to the frame at various points.

Still referring to the embodiment illustrated in FIG. 1, the concrete form 10 has three nonlinear members, in the form of steel support rods 70, 72, 74, which may be used as handles to carry the concrete form 10 and as safety devices to which harness hooks or other fall-prevention devices may be attached to prevent workers from being injured as a result of falling from the concrete form 10 when it is stacked with other forms to a significant height. The horizontal position of the vertically extending support rods 70, 72, 74 is offset from the center of the concrete form 10 to make it easier to carry the form 10 when the support rods 70, 72, 74 are used as handles and when the form 10 is carried with the outer rails 16, 18 in a generally vertical plane parallel to the ground.

The support rod 70 is disposed across the inner bay 42; the support rod 72 is disposed across the inner bay 46; and the support rod 74 is disposed across the inner bay 50. As used herein, the term "safety bay" is used to refer to a bay which has a support rod disposed across it, and the term "unobstructed bay" is used to refer to a bay which does not have a support rod disposed across it. In the concrete form 10, the two outer bays 40, 52 are unobstructed bays, and the five inner bays 42–50 include three safety bays 42, 46, 50. Each of the safety bays 42, 46, 50 is separated from another of the safety bays 42, 46, 50 by at least one of the unobstructed bays 44, 48.

Figure 3:
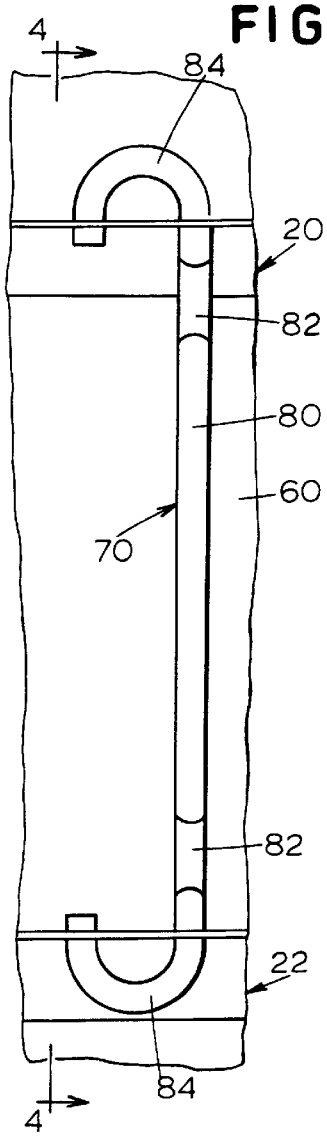
FIG. 3 is a front view of a portion of the concrete forms of FIGS. 1 and 2.
Figure 4:
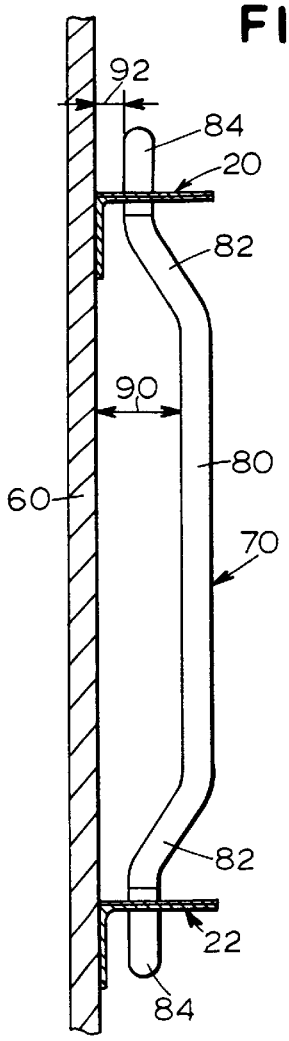
FIG. 4 is a side view of the portion of the concrete forms taken along lines 4—4 in FIG. 3.

Referring to FIGS. 3 and 4, the structure of one of the support rods 70 is shown. The support rod 70, which is circular in cross-section, has an elongated middle portion 80 with a linear central axis, two angled portions 82, and two semi-circular end portions 84. Each of the end portions 84 passes through each of the inner frame members 20, 22 twice, via a pair of holes 86 formed in each of the inner frame members 20, 22 (see FIG. 6). As shown in FIG. 4, the distance between the middle portion 80 of the support rod 70 and the concrete-forming plate 60, as indicated by an arrow 90, is greater than the distance between the end portions 84 of the support rod 70 and the concrete-forming plate 60, as indicated by an arrow 92. The increased clearance between the middle portion 80 of the support rod 70 and the plate 60 facilitates the attachment of safety hooks or other fall-prevention devices and use of the support rod 70 as a handle for carrying the concrete form 10. The ends 84 of the support rod 70 extend through the inner rails 20, 22 twice to prevent rotation of the support rod 70 and maintain it in the position shown in FIG. 4. As shown in FIG. 4, the middle portion 80 of the support rod 70 does not extend outwardly beyond the outer edges of the inner rails 20, 22.

During the manufacture of the concrete form 10 illustrated in FIG. 1, the ends 84 of each of the support rods 70, 72, 74 are first inserted into the holes 86 in adjacent ones of the inner rails 20–30, and then the adjacent ones of the inner rails 20–30 are fixed to the outer rails 16, 18, such as by welding.

When a number of concrete forms which incorporate support rods are placed together to form a wall or similar structure, the support rods are generally spaced in the bays of the concrete forms so that there is always a support rod located near a worker, to which the worker can clamp a fall-protection device, regardless of the location of the worker on the wall.

FIG. 2 illustrates a second embodiment of a concrete form which is identical to the concrete form 10 of FIG. 1, except that the concrete form of FIG. 2 has eight bays instead of seven bays and has three unobstructed inner bays instead of two unobstructed inner bays. The concrete forms illustrated in FIGS. 1 and 2 are preferably manufactured such that each of the bays has a height of one foot and a width of two feet and, thus, the FIG. 1 embodiment would be a non-standard seven feet in height whereas the FIG. 2 embodiment would be a more conventional eight feet in height, although the exact number of bays and their exact height and width is not important to the invention. As for FIGS. 1 and 2, they illustrate the preferred arrangement wherein, regardless of the height of any particular concrete form, the outer bays are unobstructed and there is at least one and no more than two unobstructed inner bays between any two safety bays.

As shown in FIG. 1, the concrete form 10 advantageously includes a gusset 94 which is strategically positioned in each of the safety bays 42, 46, and 50. The gussets 94 will be understood as being integrally associated with the inner frame members 22, 26, and 30, respectively and the rail 18 as by welding or the like. By placing the gussets in one of the two corners of each of the safety bays 42, 46, and 50 nearest the support rods 70, 72, and 74, the form is strengthened to enhance safety.

Figure 5:
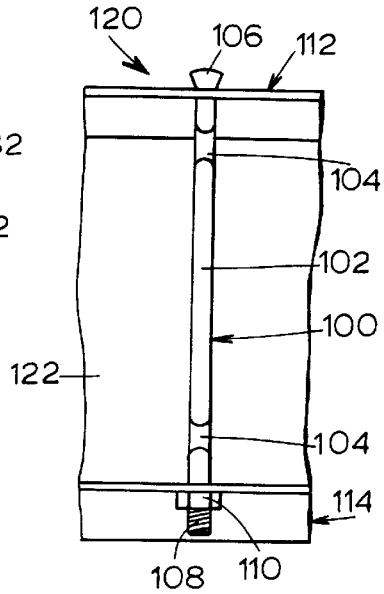
FIG. 5 is a front view of a portion of an alternative embodiment of a concrete form in accordance with the invention.

FIG. 5 illustrates an alternative support rod 100 which may be retrofitted to preexisting concrete forms. Referring to FIG. 5, the support rod 100 has an elongated middle portion 102 with a linear central axis, two angled portions 104, a first crimped or flattened end 106, and a second end with a threaded portion 108 on which a nut 110 is secured. The support rod 100 is shown attached to a pair of adjacent inner rails 112, 114 of a preexisting concrete form 120 to which a concrete-forming plate 122 is attached.

The distance between the middle portion 102 of the support rod 100 and the concrete-forming plate 122 is greater than the distance between the end portions 106, 108 and the concrete-forming plate 122 to facilitate the attachment of safety hooks or other fall-prevention devices and use of the support rod 100 as a handle for carrying the concrete form. Rotation of the support rod 100 may be prevented by welding one or both of its ends 106, 108 to their respective inner rails 112, 114. Also, the nut 110 may be spot welded to the threaded portion 108 or the inner rail 114 to prevent it from loosening.

To retrofit one of the support rods 100 to a preexisting concrete form, a hole is formed, such as by drilling or punching, in each of the two inner rails of the preexisting concrete form to which the support rod 100 is to be attached. The support rod 100 is then placed through the holes until the flattened end 106 firmly abuts the inner rail 112. The support rod 100 is then secured to the inner rails 112, 114 by threading the nut 110 onto the support rod end 108 and welding one or both ends of the support rod 100 and/or the nut 110 so that the support rod 100 is not rotatable, even when subjected to significant stresses, such as heavy objects being connected to the middle portion 102 of the support rod 100 via a hook.

Various modifications of the concrete forms described above can be made. For example, instead of providing the support rod 100 with a flattened end 106, both ends could be threaded and secured to the inner rails via nuts.

Additional modifications and alternative embodiments of the invention will be apparent to those skilled in the art in view of the foregoing description. This description of both the original equipment embodiment and the retrofit embodiment is to be construed as illustrative only, and is for the purpose of teaching those skilled in the art the best mode of carrying out the invention. The details of structure and method may be varied substantially without departing from the spirit of the invention, and the exclusive use of all modifications which come within the scope of the appended claims is reserved.

What is claimed is:

1. A method of retrofitting a support member to a preexisting concrete form having a frame with a first pair of outer frame members and a second pair of outer frame members, said first pair of outer frame members being disposed substantially perpendicular to said second pair of outer frame members so that said first and second pairs of outer frame members define a substantially rectangular shape; a first inner frame member connected between two of said outer frame members; a second inner frame member connected between said two of said outer frame members and being spaced from said first inner frame member to define a substantially rectangular bay area; and a flat concrete-forming member fixed to said frame, said concrete-forming member having a shape substantially identical to said rectangular shape defined by said outer frame members, said method comprising the steps of:

(a) placing a nonlinear support member having a first end, a second end and a middle portion in a position in which said first end of said support member is adjacent said first inner frame member, in which said second end of said support member is adjacent said second inner frame member, in which said support member is disposed a first distance from one of said outer frame members parallel to said support member and a second distance from another of said outer frame members parallel to said support member, said first distance being less than said second distance, and in which one of said ends of said support member is disposed at a third distance from said concrete-forming member and said middle portion of said nonlinear support member is disposed at a fourth distance from said concrete-forming member, said fourth distance being greater than said third distance; and (b) securing said support member to said inner frame members so that said support member is maintained in said position defined in said step (a).

2. A method as defined in claim 1 additionally comprising the steps of:

(c) prior to said step (a), forming a hole in said first inner frame member of said preexisting concrete form; and (d) prior to said step (a), forming a hole in said second inner frame member of said preexisting concrete form, wherein said step (b) comprises the step of placing said support member in said position so that said first end of said support member extends through said hole in said first inner frame member and so that said second end of said support member extends through said hole in said second inner frame member.

3. A method as defined in claim 1 wherein one of said ends of said nonlinear support member has a threaded portion and wherein said step (b) comprises the step of attaching a nut to threaded portion of said nonlinear support member.

4. A method of retrofitting a support member having a first end and second end to a preexisting concrete form having a frame with a first pair of outer frame members and a second pair of outer frame members, said first pair of outer frame members being disposed substantially perpendicular to said second pair of outer frame members so that said first and second pairs of outer frame members define a substantially rectangular shape; a first inner frame member connected between two of said outer frame members; a second inner frame member connected between said two of said outer frame members and being spaced from said first inner frame member to define a substantially rectangular bay area; and a flat concrete-forming member fixed to said frame, said concrete-forming member having a shape substantially identical to said rectangular shape defined by said outer frame members, said method comprising the steps of:

(a) retrofitting said support member to said preexisting concrete form by placing said support member in a position in which said first end of said support member is adjacent said first inner frame member of said preexisting concrete form, in which said second end of said support member is adjacent said second inner frame member of said preexisting concrete form, in which said support member is disposed a first distance from one of said outer frame members parallel to said support member and a second distance from another one of said outer frame members parallel to said support member, said first distance being less than said second distance; and (b) securing said support member to said inner frame members so that said support member is maintained in said position defined in said step (a).

* * * * *